US011136100B2

(12) United States Patent
Nation et al.

(10) Patent No.: US 11,136,100 B2
(45) Date of Patent: Oct. 5, 2021

(54) INFLATABLE MAST AND OUTRIGGER FOR UNDERSEA VEHICLES

(71) Applicant: BAE Systems Information and Electronic Systems Integration Inc., Nashua, NH (US)

(72) Inventors: Robert J. Nation, Deerfield, NH (US); Charles P. Wason, Jr., Amherst, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 101 days.

(21) Appl. No.: 16/671,755

(22) Filed: Nov. 1, 2019

(65) Prior Publication Data

US 2021/0129961 A1 May 6, 2021

(51) Int. Cl.

| | |
|---|---|
| ***B63G 8/38*** | (2006.01) |
| ***B63B 15/00*** | (2006.01) |
| ***H01Q 1/34*** | (2006.01) |

(52) U.S. Cl.

CPC ..... *B63G 8/38* (2013.01); *B63B 15/00* (2013.01); *H01Q 1/34* (2013.01); *B63B 2015/0016* (2013.01)

(58) Field of Classification Search

CPC ... B63G 8/38; B63G 8/24; H01Q 1/34; B63B 15/00; B63B 2015/0016

See application file for complete search history.

(56) References Cited

U.S. PATENT DOCUMENTS

| | | | |
|---|---|---|---|
| 2,763,341 | A | 9/1956 | Wentworth |
| 2,822,067 | A | 2/1958 | Price |
| 3,248,735 | A | 4/1966 | Bartolini |
| 3,248,831 | A | 5/1966 | Jones |
| 3,448,456 | A | 6/1969 | Pessin |
| 3,508,270 | A | 4/1970 | Cook |
| 4,262,293 | A | 4/1981 | Parmer |
| 4,426,650 | A | 1/1984 | Korsen |
| 6,269,763 | B1 | 8/2001 | Woodland |
| 6,845,728 | B1 | 1/2005 | Horton |
| 7,226,328 | B1 | 6/2007 | Puzella et al. |
| 8,179,327 | B1 | 5/2012 | Clark et al. |

(Continued)

FOREIGN PATENT DOCUMENTS

RU 2081783 C1 * 6/1997

*Primary Examiner* — Anthony D Wiest

(74) *Attorney, Agent, or Firm* — Finch & Maloney PLLC; Scott J. Asmus

(57) ABSTRACT

An inflatable mast couplable to an underwater vehicle includes a flexible material defining an interior volume, a head structure, and a spring coupled to at least one of the flexible material and the head structure. The flexible material is designed to be filled with air to form an inflated mast structure that extends away from the underwater vehicle. The head structure is disposed at a distal end of the inflated mast structure and in some cases has a rigid shape that forms a panel having an outer surface that is flush with an outer surface of the underwater vehicle, when the mast structure is deflated and stowed. The spring is designed to provide a tensile force on at least one of the flexible material and the head structure when the flexible material is inflated to form the mast structure. A system includes the inflatable mast and a pump.

20 Claims, 6 Drawing Sheets

(56) References Cited

U.S. PATENT DOCUMENTS

| | | | | |
|---|---|---|---|---|
| 10,202,173 | B2 | 2/2019 | Farber et al. | |
| 2004/0046085 | A1 | 3/2004 | Veal et al. | |
| 2011/0139956 | A1 | 6/2011 | Caswell | |
| 2012/0312215 | A1* | 12/2012 | Lyons | E21B 19/002 114/54 |

* cited by examiner

INFLATABLE MAST AND OUTRIGGER FOR UNDERSEA VEHICLES

BACKGROUND

Undersea vehicles typically use inertial measurement units (IMU) and other dead reckoning sensors to navigate while submerged. While dead reckoning sensors may provide sole-source navigation for short duration missions, accumulation of navigation error eventually requires external measurements to maintain or restore accurate performance. Significant positioning error may be incurred in a matter of minutes or even seconds. As a result, undersea vehicles regularly surface to receive GPS signals and other radio frequency (RF) transmissions. Such signals must be received or transmitted from above the water's surface, which presents complications for an underwater vehicle carrying out covert activities or that otherwise remains in the water during signal transmission.

BRIEF DESCRIPTION OF THE DRAWINGS

Features and advantages of embodiments of the claimed subject matter will become apparent as the following Detailed Description proceeds, and upon reference to the Drawings, in which:

Figure 1:
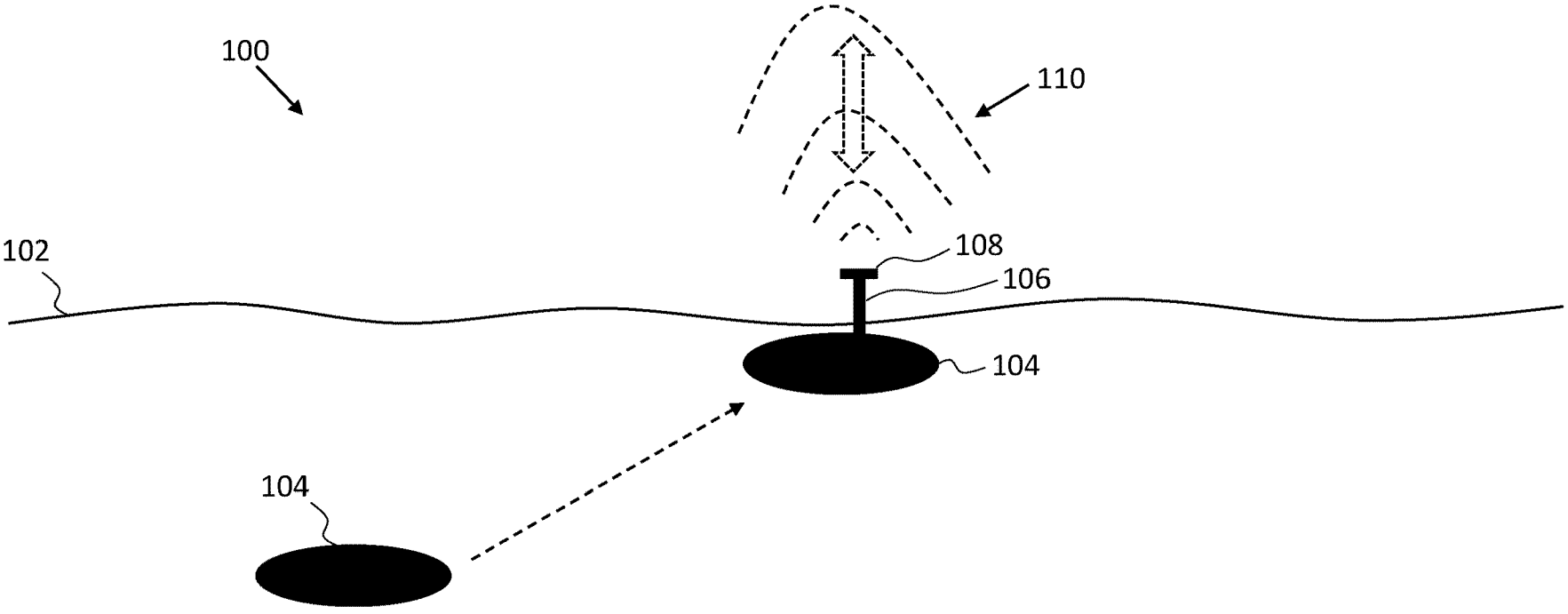
FIG. 1 illustrates an example underwater environment with an underwater vehicle configured with an inflatable mast, in accordance with some embodiments of the present disclosure.

Although the following Detailed Description will proceed with reference being made to illustrative embodiments, many alternatives, modifications, and variations thereof will be apparent in light of this disclosure.

DETAILED DESCRIPTION

Methods and structures are disclosed for an inflatable mast system for use on an underwater vehicle. The mast system includes an inflatable mast that can be selectively extended from the underwater vehicle so as to allow the underwater vehicle to receive and transmit signals from above the water's surface while the underwater vehicle remains completely submerged in the water. Once the need for deployment of the inflatable mast is satisfied, the mast can be retracted back into the underwater vehicle. Briefly, the inflatable mast extends outward from the underwater vehicle by a given height (e.g., 1 meter) and includes one or more electronic devices at a distal end of the inflatable mast that can transmit and/or receive various signals. In some embodiments, the one or more electronic devices or sensors are deployed on a head structure attached at the end of the inflatable mast. In some such cases, the head structure is rigid and shaped to match a contour of an outer panel or surface of the underwater vehicle. In some embodiments, the one or more electronic devices include one or more cameras or other sensors (e.g., temperature/heat sensors, radiation sensors, optical sensors, gas sensors, RF sensors). For example, undersea vehicles may raise sensors above the water's surface to communicate via RF or optical signals, or to observe above-water activity with cameras, electro-optical infrared sensors, radar, or RF sensors. Once signal transmission/reception or other sensor-based activity is complete, the inflatable mast can be retracted back into the underwater vehicle such that the mast does not hinder movement of the underwater vehicle as it remains submerged and moves underwater.

Another possible way to achieve such benefits might be to use a rigid mast, such as a rigid mast that telescopes or extends away from the undersea vehicle, and that includes mounted devices at its distal end. However, the rigid materials to make such a rigid mast are bulky and heavy, which limit how far the mast can reach above the water and thus further limit the feasibility of including the mast on some types of underwater vehicles (such as a water craft that is relatively small, or that cannot hold its position within the water with a very large mast extending therefrom). Using such rigid masts may also require a corresponding counterweight disposed in a keel portion of the undersea vehicle to offset the weight of the rigid mast and maintain stability of the underwater vehicle. Furthermore, the mechanisms needed for appropriately retracting rigid masts can be expensive and add further weight to the undersea vehicle.

Accordingly, some embodiments herein describe an inflatable mast for use on an underwater vehicle that alleviates all or some of the problems discussed when using rigid masts. According to one such embodiment, an inflatable mast couplable to an underwater vehicle includes a flexible material, a head structure, and a spring coupled to at least one of the flexible material and the head structure. The flexible material defines an interior volume that can be filled with air or other gas to form an inflated mast structure that extends away from the underwater vehicle, when deployed. The head structure is disposed at a distal end of the inflated mast structure and may have a rigid or semi-rigid shape. In some such cases, the rigid shape is matched to a contour of an outer surface or panel of the underwater vehicle such that it does not impede movement of the undersea vehicle when traveling. Such a rigid head structure is relatively small, and thus less problematic than an entire mast structure that is made from rigid material. As will be further explained in turn, the spring is designed to provide a tensile force on at least one of the flexible material and the head structure when the flexible material is shaped into the inflated mast structure. In some such embodiments, the inflatable mast is part of a system that further includes a pump and a snorkel. The pump provides pressurized air to shape the flexible material into the inflated mast structure and the snorkel feeds the pump with air from the atmosphere. In some such embodiments, the air used to inflate the mast is drawn from the atmosphere, so less space within the vehicle is consumed. Alternatively, the air to inflate the mast can be sourced from within the vehicle. In any such cases, the mast can be retracted and stowed by deflating it when not needed, providing a very compact solution. In some embodiments, inflatable outriggers, similar in construction to the inflatable mast, can be used to add stability to the vehicle, allowing taller masts and heavier payload to be used at the distal end of the mast. Such inflatable outriggers can be deployed prior to the deploying the inflatable mast using similar techniques as those used for inflating the mast.

An example method of providing an inflatable mast onboard an underwater vehicle is provided. The method includes raising a snorkel above an outer surface of the underwater vehicle, while the underwater vehicle remains fully submerged (if so desired). The method continues with pumping air received through the snorkel into a flexible material that defines an air-fillable void or volume, thereby inflating the flexible material into an inflated mast structure having a rigid head structure, the inflated mast structure extending away from the outer surface of the underwater vehicle. Once the mast structure is fully deployed or otherwise inflated, the method may continue with ceasing the pumping of the air into the flexible material. At this time, any number of above-surface observations can be made, using one or more sensors affixed to or otherwise included in the head structure (e.g., camera to collect image data, optical receiver to collect optical signals, RF received to collect RF data, etc). Note that, while the mast structure is deployed, the pump may be run periodically or as otherwise needed to maintain sufficient rigidness of the inflatable mast, in some embodiments, as will be appreciated. Once the above-surface operations have been conducted, the method continues with retracting the flexible material back towards the underwater vehicle via a spring coupled to at least one of the flexible material or the rigid head structure. In some embodiments, note that the pump may be reversed so as to deflate the inflated mast, by pulling out the air contained in the interior volume of the flexible material and expelling that air back through the snorkel into the above-surface atmosphere. Alternatively, the air can be recaptured or otherwise expelled into an air storage facility within the vehicle, in some embodiments.

Numerous embodiments, variations, and applications will be appreciated in light of the disclosure herein.

FIG. 1 illustrates an example maritime environment 100 in which an underwater vehicle 104 moves beneath the water's surface 102. Underwater vehicle 104 may be any kind of submerged vehicle or platform, such as an unmanned underwater vehicle (UUV), although manned underwater vehicles can equally benefit as well. As further illustrated in FIG. 1, underwater vehicle 104 may approach the water's surface 102 and extend an inflatable mast 106 having a head region 108 housing one or more electronic devices, according to an embodiment of the present disclosure.

In some embodiments, the one or more electronic devices of head region 108 includes one or more RF and/or optical receivers, transmitters, or transceivers for sending/receiving wireless communication signals 110 with, for example, a ship, aircraft, satellite, other underwater vehicle, or a land-based communication station. Data received by underwater vehicle 104 may include, for example, GPS signals to locate the underwater vehicle, messages/communications, or signals to program a processing device onboard underwater vehicle 104. Data transmitted by underwater vehicle 104 may include, for example, messages/communications, or data gathered from sensors onboard underwater vehicle 104 or on head region 108. Alternatively, or in addition, the one or more electronic devices of head region 108 may include one or more other sensors, such as a camera to capture above-surface images, a radiation sensor to detect the presence of above-surface radiation, a temperature sensor to detect the above-surface temperature, and/or a contact sensor or range-finder to detect the above-surface objects. In a more general sense, the one or more electronic devices of head region 108 may include any type of sensor or electronic equipment that can assist in communicating information to underwater vehicle 104 or from underwater vehicle 104, as will be appreciated.

Example embodiments provided herein describe using a flexible material defining an interior volume that can be inflated to form an elongated mast 106. A head region 108 disposed at the distal end of the inflated mast shape can be used to carry one or more electronic or sensor devices suitable for collecting and/or communicating data and/or messages. The light weight of the flexible material allows for taller masts to be realized, and for more electronic devices and/or heavier electronic devices to be included in head region 108. In some embodiments, and depending on factors such as the length of the inflatable mast and the size of underwater vehicle 104, inflatable outriggers can be used to add stability to the vehicle 104. The inflatable outriggers may be, for example, similar in construction to the inflatable mast. Such inflatable outriggers can be deployed prior to, or contemporaneously with, the deploying of the inflatable.

Inflatable Mast Design

Figure 2A:
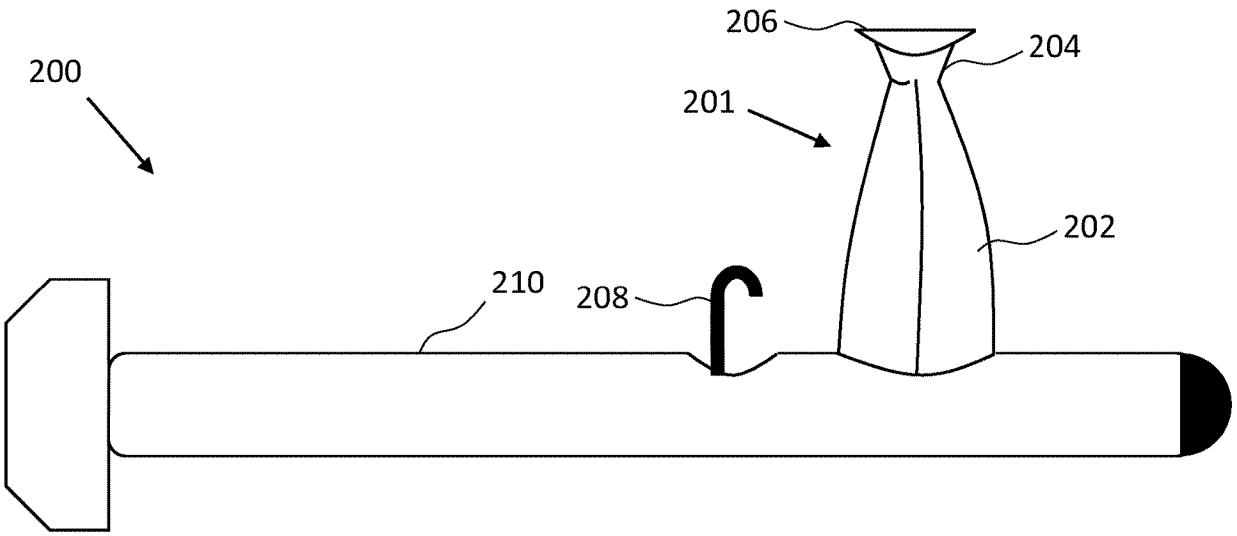
FIG. 2A illustrates an inflatable mast extending from an underwater vehicle, in accordance with some embodiments of the present disclosure.
Figure 2B:
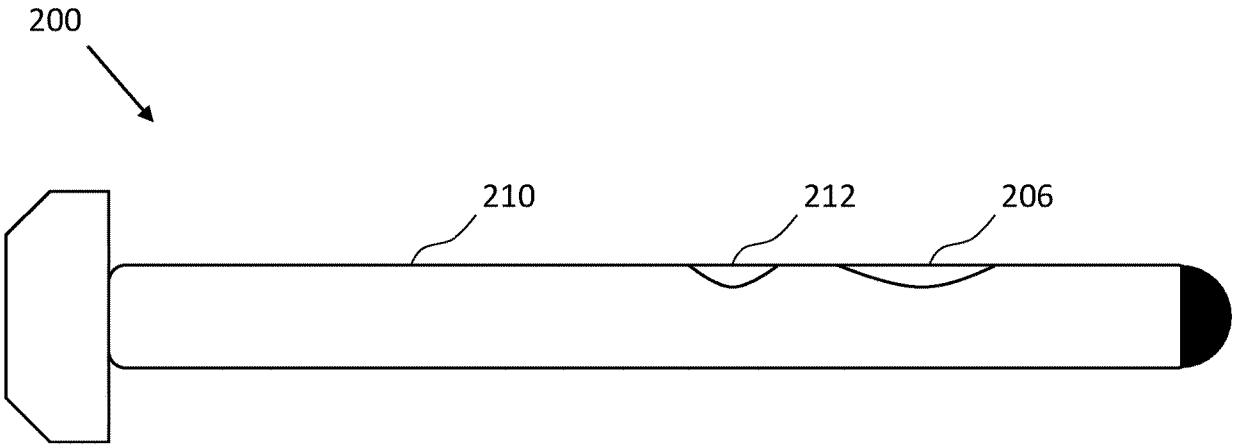
FIG. 2B illustrates the underwater vehicle of FIG. 2A having the inflatable mast fully retracted, in accordance with some embodiments of the present disclosure.

FIG. 2A illustrates an example underwater vehicle 200 having a fully extended inflated mast structure 201, according to an embodiment. FIG. 2B illustrates underwater vehicle 200 with the mast fully retracted back within an outer surface (e.g., hull 210) of underwater vehicle 200.

Inflated mast structure 201 includes a flexible material 202 that provides the shape of the mast extending away from hull 210 of underwater vehicle 200 when flexible material 202 is inflated. Flexible material 202 may be inflated using a pump onboard underwater vehicle 200 that pulls air through a snorkel 208 as will be discussed in more detail herein. According to some embodiments, flexible material 202 is an elastic polymer material such as, for example, nylon, Teflon, low-density polyethylene (LDPE), high-density polyethylene (HDPE), or polyethylene terephthalate (PETE).

The exact shape and size of inflated mast structure 201 can vary. In some embodiments, inflated mast structure 201 has an inflated base that extends the entire width of underwater vehicle 200. In some embodiments, the inflated base extends at least 90%, at least 80%, at least 75%, or at least 50% the width of underwater vehicle 200. Inflated mast structure 201 may have a height of at least 1 m. In some embodiments, inflated mast structure 201 has a height between 1 m and 2 m.

Flexible material 202 may be shaped as it is inflated using collapsible rods or other similar rigid components, such as articulated rods. The collapsible or articulated rods may be woven into flexible material 202 or attached to an inner or outer surface of flexible material 202. According to some embodiments, the shape of inflated flexible material 202 pinches inward as it extends away from hull 210, and then extends back outward to form bulbous section 204 at one end of inflated mast structure 201. Bulbous section 204 is formed to provide better support for a rigid head structure 206 at the distal end of inflated mast structure 201.

Head structure 206 may be formed of any hard plastic, composite, or metal material. In some embodiments, head structure 206 is formed from acrylonitrile butadiene styrene (ABS) plastic (e.g., using a 3-D printer or injection molding, although any number of forming processes can be used). In some embodiments, head structure 206 has a rigid shape that matches the contour of a panel of hull 210. In some embodiments, head structure 206 includes a rigid panel having an outer surface that is flush with an outer surface of hull 210 of the underwater vehicle when the mast structure 201 is in a stowed position. By matching the shape to an inset of hull 210, head structure 206 can return to a stowed position that is flush with hull 210 when inflated mast structure 201 is retracted into underwater vehicle 200 as seen in FIG. 2B. Providing a rigid or semi-rigid exterior panel on the hull of the underwater vehicle would also mitigate cavitation by providing a smooth contour.

According to some other embodiments, a separate, rigid panel (not shown) that matches the contour of underwater vehicle 200 when mast structure 201 is stowed may be hinged at the base of mast structure 201, so that it moves out of the way of the mast during deployment. When the mast is retracted and stowed, the rigid cover hinges back over the mast opening in hull 210 to provide a contour matching, low drag outer envelope around hull 210. In one example the hinged cover is a spring loaded hinge that provides a force to maintain the hinged cover in position until the mast is inflated and forces the hinged cover to open. Upon deflation and retraction of the inflatable mast, the hinged cover would close based upon the force from the spring. In another example, the hinged cover may be hydraulically actuated to both open and close. This design relaxes the form requirements for head structure 206 as it no longer needs to provide the sealed outer panel on hull 210. For example, head structure 206 may be made of the same material as flexible material 202. In one example, a contact sensor is used to ensure that the head structure or hinged panel is properly closed. The contact sensor can be deployed on the underwater vehicle and indicate closure when fully depressed. If the inflatable mast is unable to successfully retract based on a signal from the contact sensor, it could re-deploy and retract.

Head structure 206 includes one or more electronic devices for transmitting/receiving signals. The electronic devices may include any one or more of GPS receivers, infrared cameras, visible light cameras, RF transceivers, radar jammers, radar transmitters, or identification friend or foe (IFF) transponders. The electronic devices may draw power from a power supply present on head structure 206. In some embodiments, the power supply includes rechargeable batteries that may be charged using harvestable energy sources. For example, solar cells may be used to harvest energy from the sun, piezoelectric devices may be used to harvest energy from motion or vibration, and miniature wind turbines may be used to harvest energy from the wind. According to some embodiments, the rechargeable batteries are charged using an external source via wired or wireless charging.

The one or more electronic devices may be coupled to a top surface of head structure 206 and covered with a water-proof seal to prevent damage from the surrounding water. In some other embodiments, the one or more electronic devices are coupled to a bottom surface of head structure 206 such that they are protected within inflated mast structure 201. In some other embodiments, the one or more electronic devices are integrated into the material of head structure 206. Portions of the one or more electronic devices may be located in different areas on head structure 206. For example, RF circuitry may be located on a bottom surface of head structure 206 while antennas coupled to the RF circuitry are located on a top surface of head structure 206.

In some embodiments, head structure 206 includes one or more antennas or antenna arrays for transmitting/receiving signals. The antennas may include one or more patch antennas or microstrip antennas, according to some embodiments. In some embodiments, the one or more antennas support multiple communication bands (e.g., dual band operation or tri-band operation). Various ones of the antennas may support millimeter wave communications. Various ones of the antennas may support high band frequencies and low band frequencies. In some embodiments, the one or more antennas or antenna arrays may be woven into flexible material 202 or attached to an outer surface of flexible material 202.

Other designs for the distal portion of inflated mast structure 201 are also possible. In another embodiment, bulbous section 204 and head structure 206 are omitted and the sidewalls of flexible material 202 provide the structure needed to mount sensors or electronics. In some examples, whip antennas can be embedded into the side wall fabric of flexible material 202. Other electronic devices and/or sensors may be embedded in the fabric of flexible material 202 or mounted onto on outer or inner surface of flexible material 202 at or near a distal end of inflated mast structure 201.

As noted above, snorkel 208 may be used as an air intake for a pump to inflate flexible material 202 into flexible mast 201. Snorkel 208 may have an inverted U-shape as illustrated to limit liquid intake through snorkel 208. According to some embodiments, snorkel 208 is deployed above the surface of hull 210 when inflated mast structure 201 is deployed. Snorkel 208 may extend at least one or more feet above hull 210. In some embodiments, snorkel 208 is elevated into position when it is being deployed and is lowered back into a position within hull 210 when inflated mast structure 201 is retracted back within hull 210. In some other embodiments, snorkel 208 is rotated into position when it is being deployed and is rotated back into a position within hull 210 when inflated mast structure 201 is retracted back within hull 210. In either case, a panel 212 may be used to cover the opening where snorkel 208 is deployed when snorkel 208 is retracted back within hull 210. In some embodiments, panel 212 is designed to slide in place over the opening after snorkel 208 is retracted. In some embodiments, panel 212 is coupled to a backside of snorkel 208 such that rotating snorkel 208 back within hull 210 also rotates panel 212 into place to cover the opening. In one example the panel 212 is coupled to the underwater vehicle by a spring loaded hinge to maintain a spring force to keep the cover closed until there is a greater force to open the panel such as when the snorkel is deployed.

In some other embodiments, snorkel 208 is omitted from underwater vehicle 200. In such cases, compressed gas that is stored or generated on underwater vehicle 200 may be used to inflate the mast. Water can also be used to inflate the mast however the weight for the water inflated mast needs to be accounted for to maintain the orientation of the underwater vehicle. Larger sized underwater vehicles can handle the shift in center of gravity but smaller underwater vehicles might use outriggers or ballast to maintain orientation. A pump can be used to pump water into an internal bladder within the mast to cause inflation.

Figure 3:
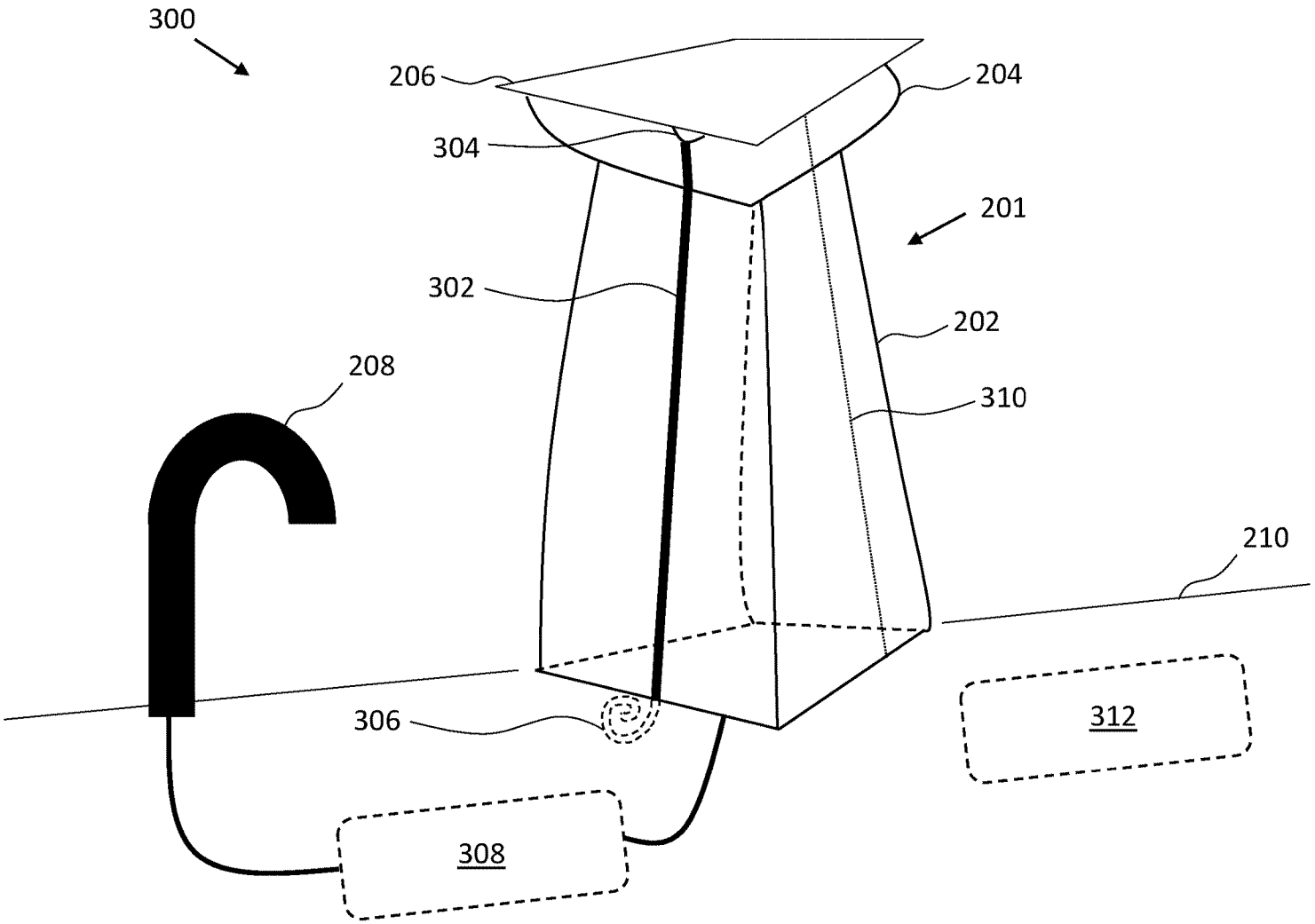
FIG. 3 illustrates a more detailed view of an inflatable mast system of an underwater vehicle, in accordance with some embodiments of the present disclosure.

FIG. 3 illustrates a more detailed view of inflated mast structure 201 that includes some components within hull 210 of the underwater vehicle that make up an inflatable mast system 300. As seen in FIG. 3, inflated mast structure 201 may include a head structure 206 having a square-shaped perimeter. The shape of head structure 206 can vary depending on the size and shape of hull 210 and can be sufficiently curved to match the same curvature of hull 210. In some embodiments, the perimeter shape of head structure 206 matches the base perimeter shape of inflated mast structure 201.

According to some embodiments, a spring 302 is provided as part of inflated mast structure 201 and extend up a length of inflated mast structure 201. Spring 302 may be coupled at one end to an anchor point 304 on flexible material 202 (e.g., on a portion of bulbous section 204) or on head structure 206. The other end of spring 302 may be coupled to an anchor point 306 within hull 210. Anchor point 306 may include a coiled portion of spring 302. In some embodiments, the length of spring 302 is not coupled to any portion of flexible material 202 (e.g., only the end portion of spring 302 is coupled to any part of flexible mast). In some other embodiments, the length of spring 302 may be entirely coupled to flexible material 202 or portions of the length of spring 302 are coupled to flexible material 202. Although only one spring 302 is illustrated, it should be understood that any number of springs may be included as part of flexible mast 201 and that each of the included springs operates in a similar manner to that described for spring 302.

According to an embodiment, spring 302 maintains a constant tensile force upon anchor point 304. However, this constant force pulling down upon either or both bulbous section 204 and head structure 206 is counteracted by the force of the pressurized air being pumped into inflated mast structure 201 via a pump 308. When pump 308 stops forcing air into inflated mast structure 201, the tensile force on spring 302 helps to pull inflated mast structure 201 back within hull 210. Flexible material 202 can collapse down onto itself as inflated mast structure 201 deflates. During inflation of inflated mast structure 201, spring 302 is stretched and the tensile force builds as inflated mast structure 201 continues to inflate.

Pump 308 may be any known type of motorized air pump. For example, pump 308 may be a pneumatic pump, a diaphragm pump, a reciprocating pump, or a rotary vane pump. Pump 308 draws air in through snorkel 208 and pumps pressurized air into inflated mast structure 201 in order to shape flexible material 202 into the mast shape. In some embodiments, pump 308 is configured to reverse the pump direction in order to pump air out of inflated mast structure 201 and through snorkel 208 into the atmosphere. A regulator (not illustrated) may be coupled with pump 308 to control pump parameters such as the air intake speed, output pressure, and purge time.

According to some embodiments, inflated mast structure 201 includes one or more conductive wires 310 that extend between any of the one or more electronic devices on head structure 206 and into hull 210. In some embodiments, conductive wires 310 provide power/ground to the one or more electronic devices from a power supply 312 within hull 210. Power supply 312 may represent any energy source, such as batteries, and may be the same power supply that powers the motor coupled to the underwater vehicle. In some embodiments, conductive wires 310 connect the one or more electronic devices to one or more processing devices and/or memory devices secured within hull 210. For example, RF signals captured using one or more sensors on head structure 206 may be transmitted through conductive wires 310 to be received by one or more processors and/or RF front end circuitry to analyze the received RF signals. In another example, images captured using a camera mounted to head structure 206 may be passed digitally through conductive wires 310 in order to be stored in memory devices located within hull 210.

Conductive wires 310 may be woven into flexible material 202. In some embodiments, conductive wires 310 are printed on either the inside or outside surface of flexible material 202. Conductive wires 310 may include an insulating jacket around the conductor to protect the wires from shorting and/or from electromagnetic interference.

Figure 4B:
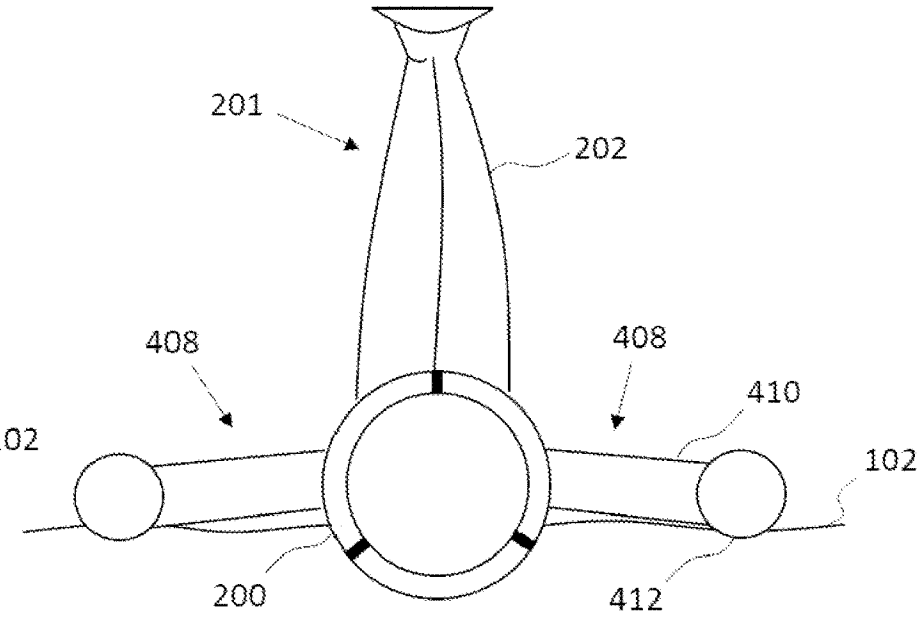
FIGS. 4A and 4B illustrate outrigger designs along with an inflatable mast on an underwater vehicle, in accordance with some embodiments of the present disclosure.
Figure 4A:
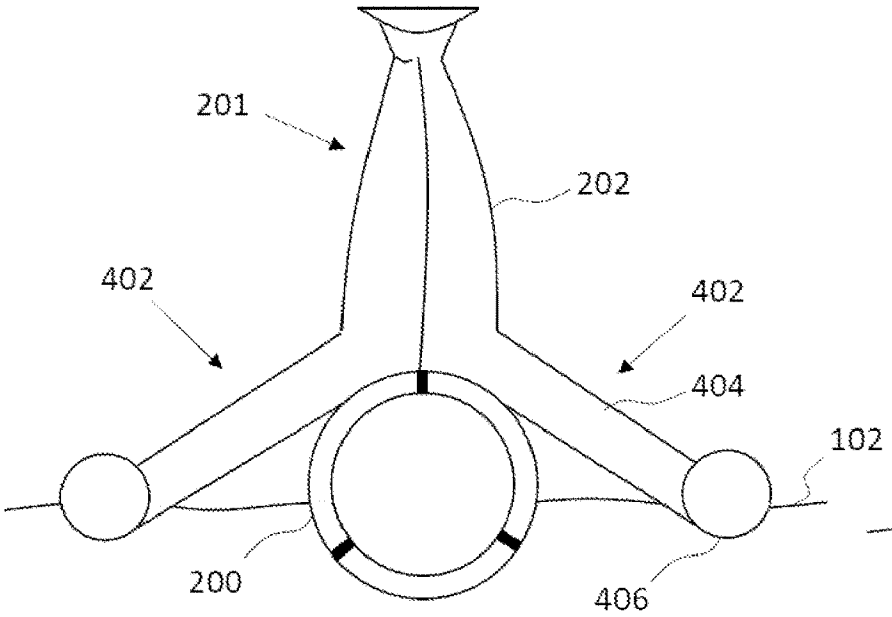

FIG. 4A illustrates a forward-facing view of underwater vehicle 200 having inflated mast structure 201 and additional outriggers 402, according to an embodiment. Although only two outriggers 402 are illustrated, any number of outriggers 402 may be included to aid in stabilizing underwater vehicle 200 when inflated mast structure 201 is deployed. The described components of a single outrigger 402 can be applied to any of the other outriggers 402.

According to an embodiment, each of outriggers 402 includes an arm 404 and a stabilizer 406. As seen in FIG. 4A, arm 404 may be a part of inflated mast structure 201, such that inflating inflated mast structure 201 also inflates arm 404 and extends arm 404 away from underwater vehicle 200 and downwards towards the water's surface 102. Accordingly, arm 404 may be made from the same material as flexible material 202 of inflated mast structure 201. In some embodiments, arm 404 is an elastic polymer material such as, for example, nylon, Teflon, low-density polyethylene (LDPE), high-density polyethylene (HDPE), or polyethylene terephthalate (PETE). In some embodiments, there is a seamless transition between flexible material 202 of inflated mast structure 201 and arm 404. Arm 404 may extend at any angle from inflated mast structure 201. Shorter arms extend at a more acute angle towards the water's surface 102, and provide reduced stability compared to longer arms. The longer the arm, the more stability imparted onto underwater vehicle 200, however, longer arms require more material, take longer to fully deploy (e.g., inflate), and may be more difficult to store back within underwater vehicle 200. In some embodiments, outriggers 402 include one or more springs that work in the same fashion as spring 302 to aid in retracting outriggers 402 back into underwater vehicle 200.

Stabilizer 406 may be located at a distal end of arm 404. In some embodiments, stabilizer 406 represents a bulbous portion at the end of arm 404 that is composed of the same flexible material as arm 404. Other shapes may be used as well for stabilizer 406 in order to impart further stability to underwater vehicle 200 as it sits at the water's surface 102. In some embodiments, stabilizer 406 includes a heavier material compared to arm 404 to provide a weighted moment-arm on either side of underwater vehicle 200. For example, stabilizer 406 may include one or more rigid components made from a heavier material such as a metal. In some examples, stabilizer 406 can be filled with the surrounding water to provide weight at the end of arm 404.

FIG. 4B illustrates an example of another design for outriggers 408, according to another embodiment. Like outriggers 402, outriggers 408 may also be extended away from underwater vehicle 200 when inflated mast structure 201 is deployed to increase stability of underwater vehicle 200. However, outriggers 408 are deployed from their own compartments on the sides of underwater vehicle 200. Since they can be deployed from sides of underwater vehicle 200, outriggers 408 can lie substantially parallel to the water's surface 102, or at least along the top of the water's surface 102. Although only two outriggers 408 are illustrated, any number of outriggers 408 may be included to aid in stabilizing underwater vehicle 200 when inflated mast structure 201 is deployed. The described components of a single outrigger 408 can be applied to any of the other outriggers 408.

According to an embodiment, each of outriggers 408 includes an arm 410 and a stabilizer 412. Arm 410 may be made from the same material as flexible material 202 of inflated mast structure 201. In some embodiments, arm 410 is an elastic polymer material such as, for example, nylon, Teflon, low-density polyethylene (LDPE), high-density polyethylene (HDPE), or polyethylene terephthalate (PETE). Arm 410 may be inflated during the same time that inflated mast structure 201 is inflated. Accordingly, the same internal pump may be used to inflate both inflated mast structure 201 and arm 410. In some embodiments, outriggers 408 include one or more springs that work in the same fashion as spring 302 to aid in retracting outriggers 408 back into underwater vehicle 200.

Stabilizer 412 may be located at a distal end of arm 410. In some embodiments, stabilizer 412 represents a bulbous portion at the end of arm 410 that is composed of the same flexible material as arm 410. Other shapes may be used as well for stabilizer 412 in order to impart further stability to underwater vehicle 200 as it sits at the water's surface 102. In some embodiments, stabilizer 412 includes a heavier material compared to arm 410 to provide weighted countermeasures on either side of underwater vehicle 200. For example, stabilizer 412 may include one or more rigid components made from a heavier material such as a metal. In some examples, stabilizer 412 can be filled with the surrounding water to provide weight at the end of arm 410. In some embodiments, stabilizer 412 includes a rigid plate having a shape that matches the contour of a panel of the hull of underwater vehicle 200. The rigid plate can align with and seat into a position in the hull surface when stowed, so that it is flush with the hull when outrigger 408 is retracted back into underwater vehicle 200.

Example Underwater Vehicle Componentry

Figure 5:
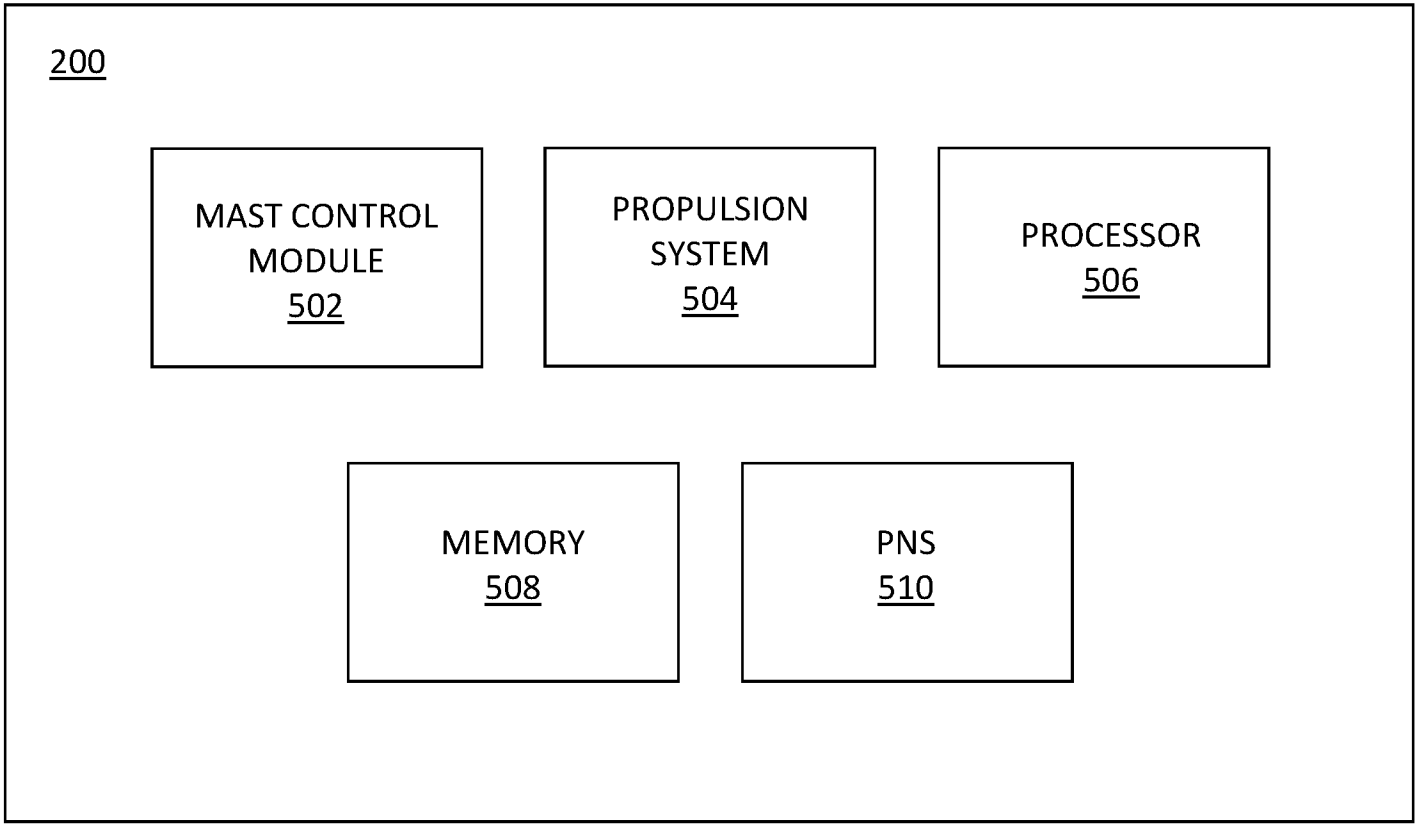
FIG. 5 illustrates components of an underwater vehicle, in accordance with some embodiments of the present disclosure.

FIG. 5 illustrates components present within underwater vehicle 200, according to some embodiments. Underwater vehicle 200 may include a mast control module 502, a propulsion system 504, a processor 506, a memory 508, and a precision navigation system (PNS) 510.

Mast control module 502 can include any circuits and/or instructions stored in memory designed to control when to deploy the inflatable mast and/or outriggers and when to retract the inflatable mast and/or outriggers. In some embodiments, mast control module 502 represents a portion of processor 506 designed to control the operations of the inflatable mast and/or outriggers. In some embodiments, mast control module 502 also controls the operation of the one or more electronic devices present on the inflatable mast.

Propulsion system 504 may include any number of elements involved in moving underwater vehicle 200 once it is submerged. Accordingly, propulsion system 504 may include a motor, a fuel source, and a propeller or jet nozzle. In some examples, the motor can turn the propeller in the water to move underwater vehicle 200. In some other examples, the motor can activate a pump that forces water out of the jet nozzle to move underwater vehicle 200. In another embodiment, the propulsion system may be a passive, buoyancy-based mechanism as used in some types of undersea gliders.

Processor 506 may represent one or more processing units that includes microcontrollers, microprocessors, application specific integrated circuits (ASICs), and field programmable gate arrays (FPGAs). According to some embodiments, processor 506 determines all of the operations performed by underwater vehicle 200. In some embodiments, processor 506 further controls all operations associated with the one or more electronic devices on the inflatable mast.

Memory 508 may represent one or more memory devices that can be any type of memory. The memory devices can be one or more of DDR-SDRAM, FLASH, or hard drives to name a few examples. Navigational routes or any other data may be preloaded into memory 508 before underwater vehicle 200 is submerged. In some embodiments, data received or collected from any of the one or more electronic devices on the inflatable mast are stored in memory 508.

PNS 510 may be included to provide additional data input for determining and/or refining the position of underwater vehicle 200. PNS 510 may include one or more inertial sensors that track movement of underwater vehicle 200.

Methodology

Figure 6:
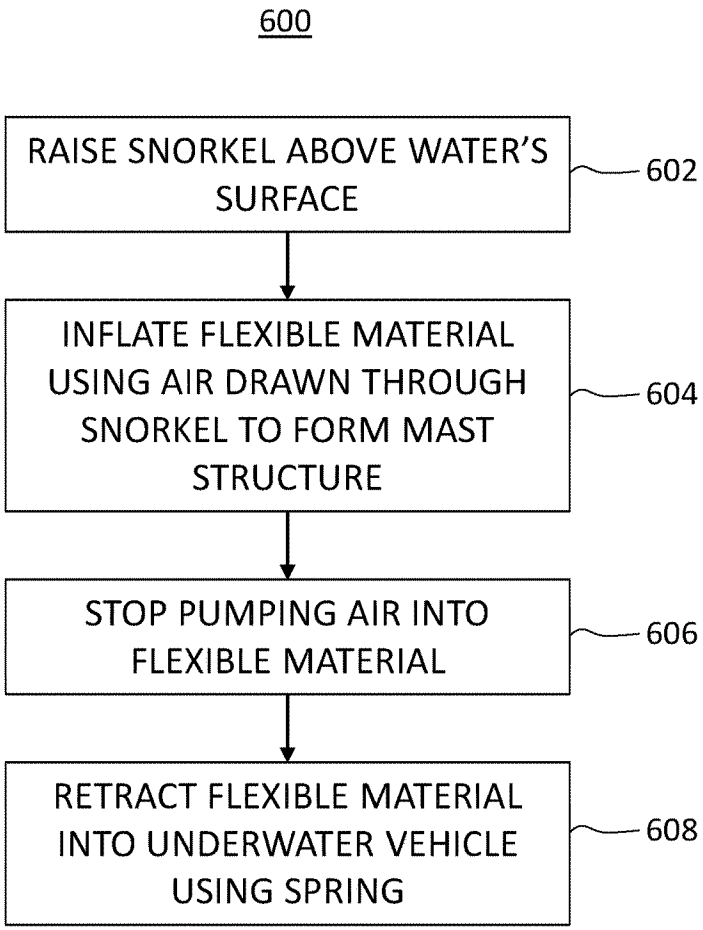
FIG. 6 is a flowchart illustrating an example method of operating an inflatable mast system on an underwater vehicle, in accordance with some embodiments of the present disclosure.

FIG. 6 illustrates an example method 600 for providing an inflatable mast onboard an underwater vehicle, in accordance with certain embodiments of the present disclosure. As can be seen, the example method includes a number of phases and sub-processes, the sequence of which may vary from one embodiment to another. However, when considered in the aggregate, these phases and sub-processes form a process for using the inflatable mast system as described above with reference to FIG. 3. However other system architectures can be used in other embodiments, as will be apparent in light of this disclosure. To this end, the correlation of the various functions shown in FIG. 6 to the specific components illustrated in the other figures is not intended to imply any structural and/or use limitations. Rather, other embodiments may include, for example, varying degrees of integration wherein multiple functionalities are effectively performed by one system. Numerous variations and alternative configurations will be apparent in light of this disclosure. For an unmanned underwater vehicle, a mission computer or other on-board processing section would be used to provide the instructions to deploy and extract the inflatable mast.

Method 600 may begin at operation 602 where a snorkel is raised above the water's surface. The snorkel may be elevated above the water's surface from an underwater vehicle. In some embodiments, the snorkel is rotated up into place above the water's surface from the underwater vehicle. As discussed above, the snorkel may have an inverted U-shape to reduce or eliminate intake of water.

Method 600 continues with operation 604 where an inflatable mast is deployed by inflating a flexible material to form the mast shape. The air is drawn in through the raised snorkel via a pump that pumps pressurized air into the inflatable mast causing it to inflate up and away from the underwater vehicle, according to an embodiment. The inflatable mast may be inflated such that it reaches a final height of at least 1 m, or a final height between 1 m and 2 m, above the underwater vehicle.

According to some embodiments, one or more outrigger structures are also inflated along with the inflatable mast to add increased stability to the underwater vehicle when the inflatable mast is deployed. The outrigger structures may form an integral part of the inflatable mast and thus are inflated along with the inflatable mast. In some embodiments, the outrigger structures are separate structures extending from the underwater vehicle, and can thus be inflated independently from the inflatable mast.

Once the mast has been fully inflated, one or more electronic devices or sensors present at a distal end of the inflated mast may be used. Such devices may allow for RF communication to take place with satellites, other marine-based vehicles, or land-based signal towers. In some embodiments, one or more cameras may be present at the distal portion of the mast and used to take photographs or infrared images of the surrounding area. In some embodiments, the one or more electronic devices or sensors are coupled to a rigid head structure present at the distal end of the inflated mast.

Method 600 continues with operation 606 where the pump ceases to provide pressurized air into the inflatable mast (and possibly into the outrigger structures as well.) Once the pressure is no longer being applied to keep the inflatable mast inflated, it will begin to naturally deflate and return towards the underwater vehicle.

Method 600 continues with operation 608 where the flexible material of the inflatable mast is retracted into the underwater vehicle using one or more springs coupled to a portion of the inflatable mast. In some embodiments, the one or more springs are coupled to at least one of the flexible material and the rigid head structure of the inflatable mast. The one or more springs provide a constant tensile force while the inflatable mast is fully inflated. Once the force from the pressurized air is removed, the tensile force from the spring helps to pull the inflatable mast back into the underwater vehicle. Similar springs may also be used to pull the outrigger structures back into the underwater vehicle after the pressurized air is removed from them. In some embodiments, the pump is used to actively purge air from within the inflatable mast and/or outrigger structures thus retracting the inflatable mast and/or outrigger structures back into the underwater vehicle.

In some other embodiments, rather than retracting the mast back into the underwater vehicle, the mast can be jettisoned away after the one or more electronic devices or sensors present at a distal end have completed their operation. The underwater vehicle then continues on its way and leaves the inflatable mast behind. This simplifies the mast construction and may be suitable for cases where the mast is only needed once, and its sensors/electronics are inexpensive.

Unless specifically stated otherwise, it may be appreciated that terms such as "processing," "computing," "calculating," "determining," or the like refer to the action and/or process of a computer or computing system, or similar electronic computing device, that manipulates and/or transforms data represented as physical quantities (for example, electronic) within the registers and/or memory units of the computer system into other data similarly represented as physical quantities within the registers, memory units, or other such information storage transmission or displays of the computer system. The embodiments are not limited in this context.

The terms "circuit" or "circuitry," as used in any embodiment herein, may comprise, for example, singly or in any combination, hardwired circuitry, programmable circuitry such as computer processors comprising one or more individual instruction processing cores, state machine circuitry, and/or firmware that stores instructions executed by programmable circuitry. The circuitry may include a processor and/or controller configured to execute one or more instructions to perform one or more operations described herein. The instructions may be embodied as, for example, an application, software, firmware, etc. configured to cause the circuitry to perform any of the aforementioned operations. Software may be embodied as a software package, code, instructions, instruction sets and/or data recorded on a computer-readable storage device. Software may be embodied or implemented to include any number of processes, and processes, in turn, may be embodied or implemented to include any number of threads, etc., in a hierarchical fashion. Firmware may be embodied as code, instructions or instruction sets and/or data that are hard-coded (e.g., non-volatile) in memory devices. The circuitry may, collectively or individually, be embodied as circuitry that forms part of a larger system, for example, an integrated circuit (IC), an application-specific integrated circuit (ASIC), a system on-chip (SoC), desktop computers, laptop computers, tablet computers, servers, smart phones, etc. Other embodiments may be implemented as software executed by a programmable control device. As described herein, various embodiments may be implemented using hardware elements, software elements, or any combination thereof. Examples of hardware elements may include processors, microprocessors, circuits, circuit elements (e.g., transistors, resistors, capacitors, inductors, and so forth), integrated circuits, application specific integrated circuits (ASIC), programmable logic devices (PLD), digital signal processors (DSP), field programmable gate array (FPGA), logic gates, registers, semiconductor device, chips, microchips, chip sets, and so forth.

Numerous specific details have been set forth herein to provide a thorough understanding of the embodiments. It will be appreciated, however, that the embodiments may be practiced without these specific details. In other instances, well known operations, components and circuits have not been described in detail so as not to obscure the embodiments. It can be further appreciated that the specific structural and functional details disclosed herein may be representative and do not necessarily limit the scope of the embodiments. In addition, although the subject matter has been described in language specific to structural features and/or methodological acts, it is to be understood that the subject matter defined in the appended claims is not necessarily limited to the specific features or acts described herein. Rather, the specific features and acts described herein are disclosed as example forms of implementing the claims.

Further Example Embodiments

The following examples pertain to further embodiments, from which numerous permutations and configurations will be apparent.

Example 1 is an inflatable mast couplable to an underwater vehicle. The inflatable mast includes a flexible material defining an interior volume configured to be filled with air, thereby taking on the shape of an inflated mast structure that extends away from the underwater vehicle. The inflatable mast also includes a head structure at a distal end of the inflated mast structure. The head structure comprises one or more electronic devices and/or sensors.

Example 2 includes the subject matter of Example 1, wherein the inflated mast structure extends away from the underwater vehicle such that a distal end of the inflated mast structure is between 1-2 meters away from the underwater vehicle.

Example 3 includes the subject matter of Example 1 or 2, further comprising a spring coupled to at least one of the flexible material and the head structure, and configured to provide a tensile force on at least one of the flexible material and the head structure when the flexible material is shaped into the inflated mast structure.

Example 4 includes the subject matter of any one of Examples 1-3, wherein the head structure has a rigid shape that is shaped to match a contour of an outer surface of the underwater vehicle.

Example 5 includes the subject matter of any one of Examples 1-3, wherein the head structure includes a rigid panel having an outer surface that is flush with an outer surface of the underwater vehicle when the inflated mast structure is in a stowed position.

Example 6 includes the subject matter of any one of Examples 1-5, wherein the flexible material is further configured to be shaped into a plurality of inflatable outriggers that extend away from the underwater vehicle.

Example 7 includes the subject matter of any one of Examples 1-6, further comprising one or more antennas on the head structure.

Example 8 includes the subject matter of any one of Examples 1-7, further comprising one or more antennas embedded in the flexible material.

Example 9 includes the subject matter of any one of Examples 1-8, further comprising a pump configured to inflate the inflated mast structure; and an air intake for the pump.

Example 10 is an inflatable mast system configured for use on an underwater vehicle. The inflatable mast system includes a flexible material defining an interior volume configured to be filled with air thereby taking on the shape of an inflated mast structure that extends away from the underwater vehicle. The inflatable mast system also includes a head structure at a distal end of the inflated mast structure, the head structure having a rigid shape. The inflatable mast system also includes a pump configured to provide pressurized air to fill the interior volume defined by the flexible material, thereby causing the flexible material to inflate into the inflated mast structure, and an air intake configured to feed the pump with air from the atmosphere.

Example 11 includes the subject matter of Example 10, wherein the head structure comprises one or more electronic devices and/or sensors, the system further comprising one or more conductive wires coupled between the one or more electronic devices and a power supply in the underwater vehicle.

Example 12 includes the subject matter of Example 10 or 11, wherein the rigid shape of the head structure is shaped to match a contour of an outer surface of the underwater vehicle.

Example 13 includes the subject matter of Example 10 or 11, wherein the head structure includes a rigid panel having an outer surface that is flush with an outer surface of the underwater vehicle when the inflated mast structure is in a stowed position.

Example 14 includes the subject matter of any one of Examples 10-13, further comprising an inflatable outrigger that extends away from the underwater vehicle.

Example 15 includes the subject matter of any one of Examples 10-14, wherein the inflated mast structure includes an inflatable outrigger portion that extends away from the underwater vehicle.

Example 16 includes the subject matter of any one of Examples 10-15, further comprising one or more antennas on the head structure.

Example 17 includes the subject matter of any one of Examples 10-16, further comprising one or more antennas embedded in the flexible material.

Example 18 includes the subject matter of any one of Examples 10-19, wherein the air intake is further configured to expel air back to the atmosphere when the inflated mast structure is deflated for stowing.

Example 19 includes the subject matter of any one of Examples 10-18, further comprising a spring coupled to at least one of the flexible material and the head structure, and configured to provide a tensile force on the at least one of the flexible material and the head structure when the flexible material is shaped into the inflated mast structure.

Example 20 is a method of providing an inflatable mast onboard an underwater vehicle. The method comprises: raising an air intake above an outer surface of the underwater vehicle; pumping air received through the air intake into a flexible material defining an interior volume thereby inflating the flexible material into an inflated structure having a rigid head structure, the inflated structure extending away from the outer surface of the underwater vehicle; ceasing the pumping of the air into the flexible material; and retracting the flexible material back towards the underwater vehicle via a spring coupled to at least one of the flexible material and the rigid head structure.

What is claimed is:

1. An inflatable mast couplable to an unmanned underwater vehicle, the inflatable mast comprising:

a flexible material defining an interior volume configured to be filled with air, thereby taking on the shape of an inflated mast structure that is directly coupled to the unmanned underwater vehicle, wherein the flexible material is an elastic polymer material; and a head structure at a distal end of the inflated mast structure, wherein the head structure is rigid and not made from the flexible material and comprises one or more electronic devices and/or sensors.

2. The inflatable mast of claim 1, wherein the inflated mast structure extends away from the unmanned underwater vehicle such that a distal end of the inflated mast structure is between 1-2 meters away from the unmanned underwater vehicle.

3. The inflatable mast of claim 1, further comprising a spring coupled on a first end to the unmanned underwater vehicle and on a second end to at least one of the flexible material and the head structure, and configured to provide a tensile force on at least one of the flexible material and the head structure when the flexible material is shaped into the inflated mast structure.

4. The inflatable mast of claim 1, wherein the head structure is shaped to match a contour of an outer surface of the unmanned underwater vehicle.

5. The inflatable mast of claim 1, wherein the head structure is a rigid panel having an outer surface that is flush with an outer surface of the unmanned underwater vehicle when the inflated mast structure is retracted in a stowed position.

6. The inflatable mast of claim 1, further comprising a plurality of inflatable outriggers that extend away from the unmanned underwater vehicle or inflated mast structure.

7. The inflatable mast of claim 1, further comprising one or more antennas on the head structure.

8. The inflatable mast of claim 1, further comprising one or more antennas embedded in the flexible material.

9. The inflatable mast of claim 1, further comprising a pump configured to inflate the inflated mast structure; and an air intake for the pump.

10. The inflatable mast of claim 1, wherein the inflated mast structure forms a bulbous section proximate the head structure.

11. An inflatable mast system configured for use on an unmanned underwater vehicle, the inflatable mast system comprising:

a flexible material defining an interior volume configured to be filled with air thereby taking on the shape of an inflated mast structure that extends away from the underwater vehicle, wherein the flexible material is an elastic polymer material;

a head structure at a distal end of the inflated mast structure, the head structure being rigid and formed from a plastic, composite, or metal material;

a pump in the unmanned underwater vehicle configured to provide pressurized air to fill the interior volume defined by the flexible material, thereby causing the flexible material to inflate into the inflated mast structure; and an air intake configured to feed the pump with air from the atmosphere.

12. The inflatable mast system of claim 11, wherein the head structure comprises one or more electronic devices and/or sensors, the system further comprising one or more conductive wires coupled between the one or more electronic devices and a power supply in the unmanned underwater vehicle.

13. The inflatable mast system of claim 11, wherein the head structure is shaped to match a contour of an outer surface of the unmanned underwater vehicle.

14. The inflatable mast of claim 11, wherein the unmanned underwater vehicle includes a separate rigid panel having an outer surface that is flush with an outer surface of the unmanned underwater vehicle when the inflated mast structure is retracted in a stowed position.

15. The inflatable mast system of claim 11, further comprising an inflatable outrigger that extends away from the unmanned underwater vehicle or the inflated mast structure.

16. The inflatable mast system of claim 11, further comprising one or more antennas on the head structure.

17. The inflatable mast system of claim 11, further comprising one or more antennas embedded in the flexible material.

18. The inflatable mast system of claim 11, wherein the air intake is further configured to expel air back to the atmosphere when the inflated mast structure is deflated for stowing.

19. The inflatable mast system of claim 11, further comprising a spring coupled on a first end to the unmanned underwater vehicle and on a second end to at least one of the flexible material and the head structure, and configured to provide a tensile force on the at least one of the flexible material and the head structure when the flexible material is shaped into the inflated mast structure.

20. A method of providing an inflatable mast onboard an unmanned underwater vehicle, the method comprising:

raising an air intake above an outer surface of the underwater vehicle;

pumping air received through the air intake into a flexible material defining an interior volume thereby inflating the flexible material into an inflated structure having a rigid head structure formed from plastic, composite or metal material, the inflated structure extending away from the outer surface of the unmanned underwater vehicle, wherein the flexible material is an elastic polymer material;

ceasing the pumping of the air into the flexible material; and retracting the flexible material back towards the underwater vehicle via a spring coupled from the unmanned underwater vehicle to at least one of the flexible material and the rigid head structure, stabilizing the unmanned underwater vehicle by inflating an inflatable outrigger.

* * * * *